US011410536B2

(12) United States Patent
Duro

(10) Patent No.: US 11,410,536 B2
(45) Date of Patent: Aug. 9, 2022

(54) SOPHISTICATED ALARM SYSTEM

(71) Applicant: Orange, Issy-les-Moulineaux (FR)

(72) Inventor: Jean-Marc Duro, Chatillon (FR)

(73) Assignee: Orange, Issy-les-Moulineaux (FR)

( * ) Notice: Subject to any disclaimer, the term of this patent is extended or adjusted under 35 U.S.C. 154(b) by 0 days.

(21) Appl. No.: 17/337,236

(22) Filed: Jun. 2, 2021

(65) Prior Publication Data

US 2021/0383677 A1 Dec. 9, 2021

(30) Foreign Application Priority Data

Jun. 3, 2020 (FR) ..... 2005817

(51) Int. Cl.

| | |
|---|---|
| ***G08B 29/04*** | (2006.01) |
| ***G08B 17/06*** | (2006.01) |
| ***G08B 26/00*** | (2006.01) |
| ***G08B 29/10*** | (2006.01) |

(52) U.S. Cl.

CPC ..... *G08B 29/043* (2013.01); *G08B 17/06* (2013.01); *G08B 26/007* (2013.01); *G08B 29/10* (2013.01)

(58) Field of Classification Search

CPC ..... G08B 29/043; G08B 29/10; G08B 17/06; G08B 26/007

See application file for complete search history.

(56) References Cited

U.S. PATENT DOCUMENTS 7,629,894 B2 * 12/2009 Plocher ..... G08B 3/10 340/331
7,880,604 B2 * 2/2011 McKenna ..... G08B 3/10 340/506
7,889,066 B2 * 2/2011 McKenna ..... G08B 7/066 340/506
8,432,277 B2 * 4/2013 Egawa ..... G08B 3/10 700/32
9,171,450 B2 * 10/2015 Cho ..... H04W 4/90
2007/0279242 A1 * 12/2007 Plocher ..... G08B 3/10 340/332

(Continued)

FOREIGN PATENT DOCUMENTS

| | | |
|---|---|---|
| GB | 2 225 661 A | 6/1990 |
| KR | 102 101 815 B1 | 4/2020 |

OTHER PUBLICATIONS

French Search Report with Written Opinion for French Application No. 2005817, dated Jan. 29, 2021.

*Primary Examiner* — Hoi C Lau

(74) *Attorney, Agent, or Firm* — Knobbe, Martens, Olson & Bear, LLP

(57) ABSTRACT

The disclosure relates to an alarm system comprising a plurality of detectors, each configured to detect an event in an environment and to emit an event detection signal, and a plurality of alarm signal emitters, each configured to emit at least one alarm signal in case of the detection of an event, the detectors and the emitters being linked to one another, wherein each of the emitters is configured to emit a plurality of distinct alarm signals. In case of the detection of an event by a first detector, a first identifier is assigned to at least one first emitter, the closest to the first detector out of the plurality of emitters, and an alarm generation instruction is transmitted to the first emitter with the first identifier, to activate the first emitter with a first alarm signal which is a function of the first identifier.

15 Claims, 8 Drawing Sheets

(56) References Cited

U.S. PATENT DOCUMENTS

| | | | | |
|---|---|---|---|---|
| 2008/0309486 | A1* | 12/2008 | McKenna | G08B 25/10 340/540 |
| 2009/0201143 | A1* | 8/2009 | McKenna | G08B 25/012 340/506 |
| 2010/0026490 | A1* | 2/2010 | Butler | G08B 13/2494 340/552 |
| 2010/0295677 | A1* | 11/2010 | Egawa | G08B 17/00 340/540 |
| 2014/0253326 | A1* | 9/2014 | Cho | G08B 25/10 340/539.11 |
| 2015/0130641 | A1* | 5/2015 | Rahman | H04W 84/18 340/932.2 |
| 2021/0383677 | A1* | 12/2021 | Duro | G08B 26/007 |

* cited by examiner

SOPHISTICATED ALARM SYSTEM

CROSS-REFERENCE TO RELATED APPLICATIONS

This application claims foreign priority to FR 2005817, filed Jun. 3, 2020, the contents of which are incorporated by reference herein in its entirety.

BACKGROUND

Field

The present disclosure relates to the field of alarm systems.

Description of the Related Technology

It is known practice to provide an alarm system, for example installed in the premises of a building, and typically comprising:

- a plurality of detectors, each configured to detect an event in an environment defined by a range of detection of the detector, and to emit, in case of the detection of an event, an event detection signal, and
- a plurality of alarm signal emitters, each configured to emit at least one alarm signal in case of the detection of an event.

This event can be a starting of a fire, or even smoke, or, alternatively, even an open window or door, or even an intrusion, or the like.

The alarm signal emitters can for example be loudspeakers emitting a sound signal such as an alarm siren. Alternatively (or in addition), the alarm signal emitters can comprise lamps for emitting light flashes, or the like.

The detectors and the emitters are linked to one another, for example by wired links, often to a central supervisory unit.

Upon an intervention from fire fighters, in the presence of smoke during a fire in particular, the blind guiding of the fire fighters is a brake to the speed and the effectiveness of the intervention, all the more so as the fire fighters do not necessarily know the premises.

Furthermore, the evacuation of the occupants, aggravated by the simultaneous howling of the sirens in all directions, is disturbed by the lack of markers, with the risk of approaching the fire instead of moving away from it.

Moreover, during exercises, for example biannual, in fire evacuations, the people responsible for organizing the evacuees remain longer than the others in proximity to the sirens whose sound level is close to the pain threshold, possibly resulting in auditory damage and tinnitus.

In a conventional alarm system, of the abovementioned type, the detectors and the emitters are connected to a central supervisory system and have no direct interaction with one another.

The detection function is distinct from the generation of the alarm signals (sirens for sound signals). The management of the sirens is entrusted to the central supervisory system. The sirens in the same overall zone howl at the same time and at the same maximum sound level.

While the central supervisory system indicates which detector has triggered the alarm, the location thereof is not necessarily specific for the responders who have to precisely locate the alarm initiation in the zone on a plan. In the presence of smoke, the visual location on a plan, already the source of delay in normal times, becomes inoperative.

The present disclosure enhances the situation.

SUMMARY OF CERTAIN INVENTIVE ASPECTS

A method for managing an alarm system is proposed, the alarm system comprising:

- a plurality of detectors, each configured to detect an event in an environment defined by a range of detection of the detector, and to emit, in case of the detection of an event, an alarm detection signal, and
- a plurality of alarm signal emitters, each configured to emit at least one alarm signal in case of the detection of an event, the detectors and the emitters being linked to one another.

In particular, each of the emitters is configured to emit a plurality of distinct alarm signals, and the method can comprise at least the steps of:

a) in case of the detection of an event by a first detector, assigning a first identifier to at least one first emitter, the closest to the first detector out of the plurality of emitters, and transmitting an alarm generation instruction to the first emitter with the first identifier, to activate the first emitter with a first alarm signal which is a function of the first identifier, b) modifying the first identifier to produce a second identifier from the first identifier and assigning the second identifier to at least one second emitter, the closest neighbor of the first emitter, c) transmitting an alarm generation instruction to the second emitter, to activate the second emitter with a second alarm signal which is a function of the second identifier.

Thus, the successive modifications of identifiers spread out step-by-step to the emitters of the system to activate these emitters with distinct respective alarm signals, which makes it possible to guide responders to the emitter which is emitting the first alarm signal specific to the starting of the fire, for example in the case where the event to be detected is a fire. In this case, the first emitter is preferentially located in the environment of the first detector.

Moreover, in practice, both (emitter and detector) can be produced in the same housing, for example. More generally, each detector of the system can be installed in the same housing with an emitter of the system and linked to this emitter, for example by a wired link.

In one possible embodiment, the steps b) and c) can be reversed as presented later in an embodiment.

The abovementioned modification of the identifier can be, for example, an incrementation of an index representing this identifier, such as an incrementation of a token, for example in a peer-to-peer telecommunication data transmission. As a variant, it can be a modification of an alphanumeric character string (for example AA is modified to AB then to AC, etc.), or the like.

Thus, in one embodiment, it is possible to:

d) repeat the steps b) and c) N times (with N greater than 3 for example) by transmitting an alarm generation instruction to at least one $N^{th}$ next emitter, the closest neighbor of an $N-1^{th}$ preceding emitter, to activate the $N^{th}$ next emitter with an alarm signal which is a function of an $N^{th}$ identifier assigned to the $N^{th}$ emitter, the $N^{th}$ identifier having been produced from an $N-1^{th}$ identifier assigned to the $N-1^{th}$ emitter.

It will thus be understood that it is possible to provide up to N distinct alarm signals (SA1, SA2, SA3, etc.) which are functions of the respective identifiers (I1, I2, I3, etc.) assigned to the emitters, as illustrated in FIG. 3 discussed later.

In one embodiment, these alarm signals can be distinguished by respective modulations chosen to confer on each alarm signal a decreasing energy as a function of a number of successive modifications applied to the first identifier (or a decreasing power, if the abovementioned energy is reduced to a time unit).

An alarm signal can for example consist of a succession of pulses (for example sound beeps), the number of which per unit of time decreases as a function of the successive modifications of the abovementioned first identifier. Thus, in this case where each alarm signal comprises a succession of pulses with a chosen number of pulses per unit of time, the number of pulses per unit of time in an alarm signal decreases as a function of the number of successive modifications applied to the first identifier. In addition or as a variant, it is possible to simply provide a decreasing sound intensity, or a decreasing sound frequency, with the successive modifications of the first identifier.

Thus, each of the emitters is configured to emit a plurality of distinct alarm signals (SA1, SA2, SA3, etc.) and stores these signals in memory matched with respective identifiers (I1, I2, I3, etc.) which can be assigned to it.

In an embodiment in which the alarm system is installed in a building and comprises at least one secondary emitter at the periphery of the building, this secondary emitter can, on the other hand, be activated at least in the step c), to emit an alarm signal of maximum energy out of the alarm signals. Indeed, it is advisable in any case to alert the responders to the place of the building where the event has occurred.

In a first embodiment, the emitters can communicate with one another via a short-range radio frequency link and the step c) precedes the step b). Thus, in the step c), the first emitter emits the first identifier with an alarm generation instruction to one or more emitters within its range, and at least the second emitter, within the radio frequency range of the first emitter, on reception of the alarm generation instruction with the first identifier, modifies the first identifier to produce the second identifier according to the step b). The method can then continue with an emission, by the second emitter, of an alarm generation instruction with the second identifier, to one or more emitters within the range of the second emitter, and so on.

"Short range" is understood here to mean a radio frequency link of Bluetooth, or even Wifi, type, or other such links (Wireless M-Bus, 6LowPAN, ZigBee, etc.), in contrast to radio frequency links of greater range such as LLORA® in particular (or even WiMax, etc.).

This first embodiment allows a variant in as much as one emitter uses an identifier Ij to emit the corresponding alarm signal SAj but then performs the modification of the identifier Ij–>Ij+1 before sending the new identifier Ij+1 to the emitter within its radio frequency range.

Thus, in such a variant, the emitters can communicate with one another via a short-range radio frequency link and the step c) follows the step b), so that, in the step b), the first emitter modifies the first identifier to produce the second identifier, and, in the step c), the first emitter emits the second identifier with an alarm generation instruction to one or more emitters within its range. Next, at least the second emitter, within the radio frequency range of the first emitter, on reception of the alarm generation instruction with the second identifier, emits the second alarm signal which is a function of the second identifier and modifies the second identifier to produce a third identifier. The method can then continue with an emission, by the second emitter, of an alarm generation instruction with the third identifier, to one or more emitters within the range of the second emitter, and so on.

In a second embodiment, the detectors and the emitters are linked to one another via a central unit, storing location data of the detectors and of the emitters in memory, and the central unit:

- on reception of an event detection signal from the first detector, locates the first emitter as emitter closest to the first detector as a function of the data stored in memory, assigns the first identifier to the first emitter, and emits an alarm generation instruction with the first identifier to the first emitter for the implementation of the step a),
- locates the second emitter as emitter closest to the first emitter as a function of the data stored in memory, modifies the first identifier to produce the second identifier according to the step b), assigns the second identifier to the second emitter, and emits an alarm generation instruction with the second identifier to the second emitter for the implementation of the step c).

The present disclosure also targets an alarm system comprising:

- a plurality of detectors, each configured to detect an event in an environment defined by a range of detection of the detector, and to emit, in case of the detection of an event, an event detection signal, and
- a plurality of alarm signal emitters, each configured to emit at least one alarm signal in case of the detection of an event.

The detectors and the emitters are linked to one another.

Each of the emitters is configured to emit a plurality of distinct alarm signals, and:

- a) in case of the detection of an event by a first detector, a first identifier is assigned to at least one first emitter, the closest to the first detector out of the plurality of emitters, and an alarm generation instruction is transmitted to the first emitter with the first identifier, to activate the first emitter with a first alarm signal which is a function of the first identifier,
- b) the first identifier is modified to produce a second identifier, and
- c) an alarm generation instruction is transmitted to at least one second emitter, the closest neighbor of the first emitter, to activate the second emitter with a second alarm signal which is a function of the second identifier.

The present disclosure also targets an emitter of such an alarm system, configured to emit a plurality of distinct alarm signals, this emitter storing data of the alarm signals in memory matched with respective identifiers, to emit a specific alarm signal as a function of a given identifier.

In the abovementioned first embodiment, such an emitter can be able to communicate with the emitters of the system via a short-range radio frequency link, and can be configured to:

- receive an alarm generation instruction with a current identifier,
- modify the current identifier to produce a modified identifier,
- emit an alarm signal which is a function of the modified identifier, and
- emit, via the radio frequency link, an alarm generation instruction with the modified identifier.

The present disclosure also targets a central unit of an alarm system according to the abovementioned second embodiment, wherein the central unit is configured to be linked to the detectors and to the emitters of the system and to store location data of the detectors and of the emitters in memory. The central unit is further configured to:

on reception of an event detection signal from the first detector, locate the first emitter as emitter closest to the first detector as a function of the data stored in memory, assign the first identifier to the first emitter, and emit an alarm generation instruction with the first identifier to the first emitter, locate the second emitter as emitter closest to the first emitter as a function of the data stored in memory, modify the first identifier to produce the second identifier, assign the second identifier to the second emitter, and emit an alarm generation instruction with the second identifier to the second emitter.

According to another aspect, a computer program is proposed that comprises instructions for the implementation of the above method, when these instructions are executed by a processor or a processing circuit.

These instructions can be distributed to the emitters in particular and/or to the abovementioned central unit.

According to another aspect, a non-transient storage medium is proposed that can be read by a computer and on which such a program is stored.

BRIEF DESCRIPTION OF THE DRAWINGS

Other features, details and advantages will emerge on reading the following detailed description, and on analyzing the attached drawings, in which.

DETAILED DESCRIPTION OF CERTAIN ILLUSTRATIVE EMBODIMENTS

Figure 1:
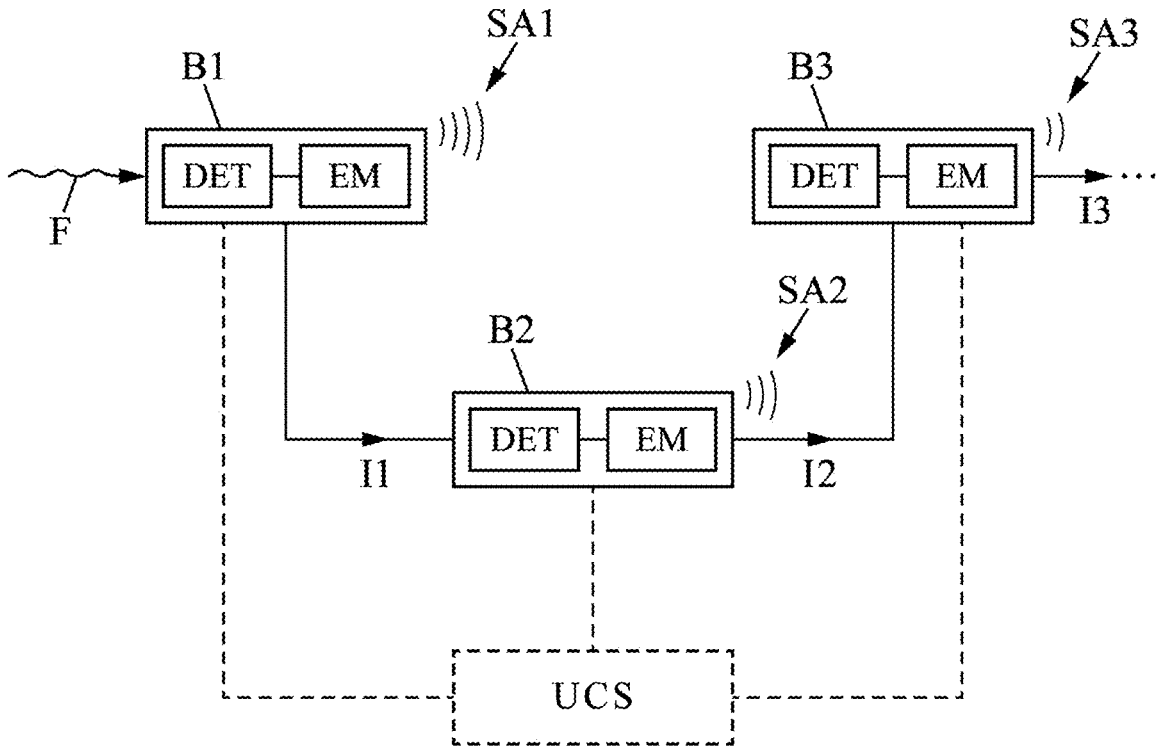
FIG. 1 schematically shows a system according to an exemplary embodiment.

Reference is now made to FIG. 1, in which an alarm system within the meaning of the disclosure is represented, comprising a plurality of detectors DET and a plurality of emitters Em. In the example represented, each detector is grouped together with an emitter in the same housing B1, B2, B3, etc.

In this example, the link between the detector and the emitter can be wired.

Alternatively, the detector DET and the emitter Em can be physically separate. It is however preferable to provide an emitter Em in the detection environment of a detector DET. Thus, when a detector DET detects an event (arrow F) in its environment, an emitter Em, linked (by a wired or radio frequency link) to this detector DET, can emit an alarm signal (arrow SA1 at the output of the housing B1 in the example of FIG. 1), to indicate to responders the place where the event F is specifically occurring.

Thus, for example, in FIG. 1, the other detectors of the housings B2, B3, have not (yet) detected the event F. Nevertheless, the emitter Em of the housing B1 emits an alarm signal SA1, and, within the meaning of the disclosure, an identifier I1 specific to the emitter of the housing B1, is sent to the emitter Em of the housing B2 geographically closest to the housing B1 out of the housings of the alarm system.

To this end, in a first embodiment, the emitters Em of the housings can be linked by a short-range radio frequency link (for example connected by Bluetooth) and each housing B2, B3 is placed within the radio frequency range of at least one other housing B1, B2. Thus, in this first embodiment, the emitter of the housing B2 receives the identifier I1 of the emitter of the housing B1 by the abovementioned Bluetooth connection.

As a variant, in a second embodiment, all the detectors and emitters are connected (by radio frequency or wired link) to a central supervisory unit UCS which stores the locations of each detector DET and of each emitter Em of the alarm system in memory. Thus, in case of the detection of an event F by a detector DET (of the housing B1 in the example of FIG. 1), the latter transmits an event detection signal to the UCS unit. On reception of this detection signal, the UCS unit activates the emitter Em in the environment of this detector to emit the alarm signal SA1, and sends the abovementioned identifier I1 to the emitter Em of the housing B2.

In the first embodiment as in the second embodiment, the first identifier I1 is assigned to the emitter Em of the housing B1 comprising the first detector DET which detects the event F. The emitter Em of this housing B1 emits the alarm signal SA1 which can for example take the form of a succession of pulses (FIG. 4), for example of sound beeps in the case of an acoustic alarm signal such as a siren.

Figure 4:
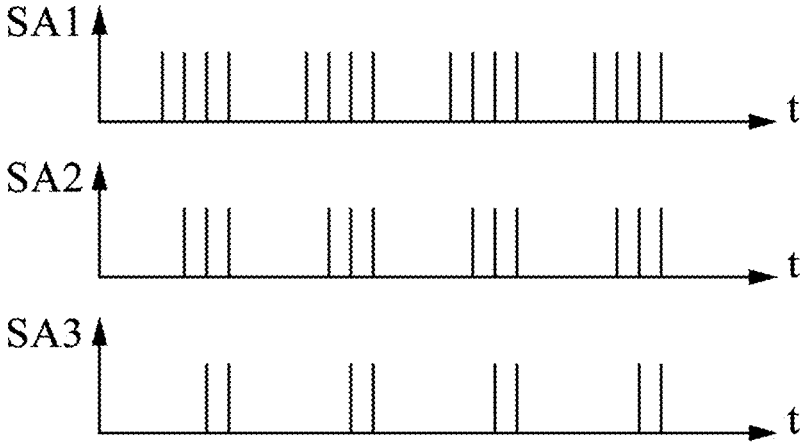
FIG. 4 illustrates time variations of these alarm signals SA1, SA2, SA3, etc., according to an exemplary embodiment.

In the first embodiment, the emitter Em of the first housing B1 sends this first identifier I1 to the emitter Em of the housing B2 closest to the housing B1, and this latter emitter Em-B2:

interprets the reception of this identifier I1 as an alarm signal emission instruction, modifies the first identifier I1 to produce a second identifier I2 (the modification of the identifier being able to be simply an incrementation, as presented later in an exemplary embodiment with reference to FIG. 2), and emits an alarm signal SA2 comprising fewer pulses per unit of time than the signal SA1, as illustrated in FIG. 4.

Next, the emitter Em of the housing B2 sends its second identifier I2 to the emitter Em of a third housing B3 closest to the housing B2 (within its Bluetooth range), which emitter Em-B3, in turn:

interprets the reception of this identifier I2 as an alarm signal emission instruction, modifies the second identifier I2 to produce a third identifier I3 to be transmitted to its closest neighbor, and emits an alarm signal SA3 comprising fewer pulses per unit of time than the signal SA2, as illustrated in FIG. 4.

Thus, it will be understood that the first identifier I1 is dynamic (i.e. it is not assigned definitively to one emitter of one given housing). The identifier I1 is assigned to the emitter associated with the first detector which has detected the event (a starting of a fire for example). A first alarm signal SA1 is then generated. Next, this identifier I1 is modified step-by-step to successively generate alarm signals SA2, SA3, etc. which comprise increasingly fewer pulses per unit of time than the first alarm signal SA1, as illustrated in FIG. 4.

Figure 3:
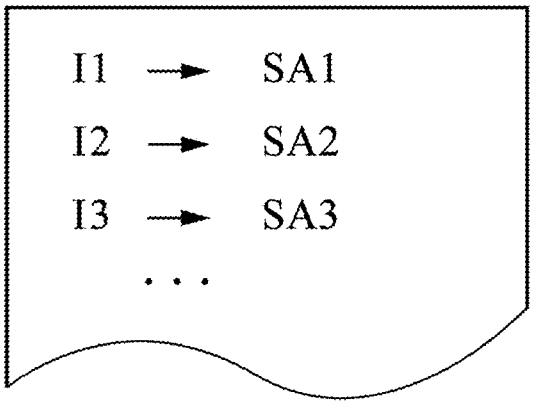
FIG. 3 illustrates a mapping table, stored in the memory of each emitter, between the identifiers I1, I2, I3, etc., that can be assigned to this emitter, and the corresponding alarm signals SA1, SA2, SA3, etc., that this emitter can emit.

There is thus a correlation, as illustrated in FIG. 3, between the identifier Ij which is received by an emitter and the alarm signal SAj+1 that this emitter emits. In practice, each emitter stores a mapping table between each identifier I1, I2, I3, etc., which can be assigned to it, and the alarm signal SA1, SA2, SA3, etc. that it has to send. Thus, if it receives an identifier Ij−1, it modifies this identifier to produce an identifier Ij and emits the alarm signal SAj.

In this exemplary embodiment, each emitter is programmed to receive an identifier Ij−1, modify this received identifier Ij−1 to produce a modified identifier Ij and be assigned this modified identifier Ij to emit a corresponding alarm signal SAj, then to transmit this modified identifier Ij to its nearby emitters. In a variant embodiment, each emitter can be programmed to receive an identifier Ij, produce a corresponding alarm signal SAj and then modify this received identifier Ij to produce a modified identifier Ij+1 to be transmitted to its nearby emitters. Thus, in this variant, each emitter handles the modification of the identifier for a neighboring emitter.

In one or other of these embodiments according to the abovementioned first embodiment, the identifiers are transmitted and modified by the emitters, step-by-step, without a central supervisory unit UCS needing to intervene. It will thus be understood that, in this first embodiment, the optional UCS unit is represented in FIG. 1 by dotted lines for this reason.

In the second embodiment involving a central supervisory unit UCS, the latter assigns the respective identifiers I1, I2, I3 to the emitters of the successive housings B1, B2, B3 as a function of their respective locations, relative first of all to the detector of the housing B1, the first to detect the event F (the associated emitter receiving the identifier I1), then relative to the closest neighbor of the emitter of this housing B1 (the associated emitter Em-B2 receiving the identifier I2), then relative to the closest neighbor of the emitter of the housing B2 (the associated emitter Em-B3 receiving the identifier I3), and so on. Each emitter, receiving its identifier Ij from the UCS unit, is programmed to consult the mapping table that it stores (FIG. 3) and emit an alarm signal SAj corresponding to the received identifier Ij.

Figure 2:
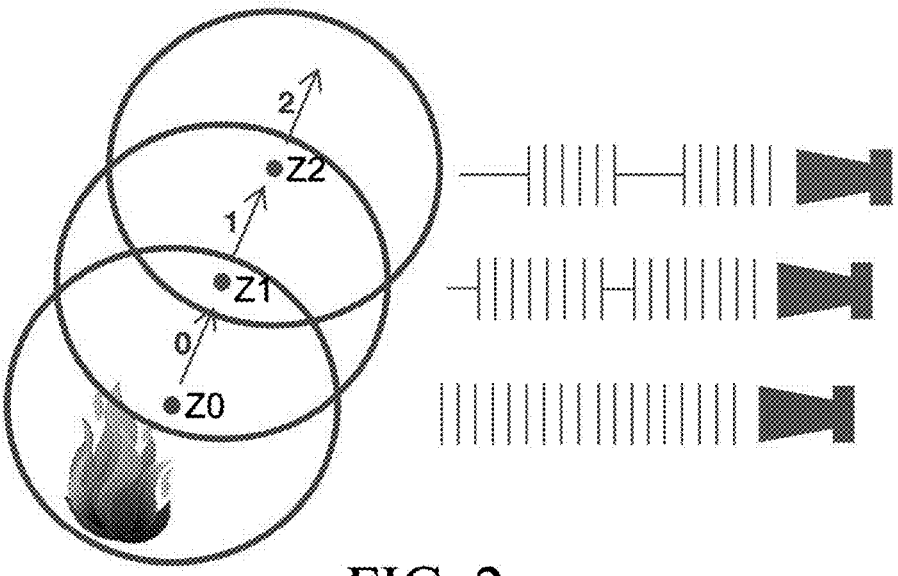
FIG. 2 schematically illustrates the effect of an implementation according to the disclosure.

FIG. 2 schematically illustrates the effect of an implementation of the present disclosure, in the case, by way of example, of emissions from alarm sirens in the case of the starting of a fire.

A network of housings comprising respective fire detectors are interconnected by short-range radio frequency link and signal proximity to the focus of the fire by modulation of the sirens. Each housing is equipped, for example in addition to its link to a central supervisory unit (optional), with a short-range radio frequency link (for example Bluetooth). The detector of the housing situated in a zone Z0 and close to the flames emits a short-range radio signal corresponding to an identifier bearing a number (for example 0). Here, for example, the abovementioned first identifier I1 is such that I1=0. The nearby housings situated in respective zones Z1, Z2, etc., relay the signal by incrementing the abovementioned number (I2=1, I3=2, etc.). A housing receiving a signal whose number is greater than that which it has itself emitted does not relay the signal to avoid a risk of a feedback loop. In fact, the signal number increases with the distance from the focus of the fire.

With reference to FIG. 2, the housing in the zone Z0 detects the fire and emits the alarm signal numbered 0. The emitter of this housing emits a siren according to a continuous sound. The housing in the zone Z1 in common with Z0 receives the signal numbered 0, transmits a signal numbered 1, and emits a siren in the zone Z1 according to a slightly modulated sound. The signal numbered 1 is disregarded by the first housing in the zone Z0 because its identifier I1=0 is of a value lower than the second identifier I2=1. The housing in the zone Z2 in common with Z1 receives a signal numbered 1, emits a siren according to a more greatly modulated sound, and transmits a signal numbered 2, and so on. The signal numbered 2 is disregarded by the housing in the zone Z1, because it is of a number greater than that of its own signal (1).

The howling of the sirens is thus modulated as a function of the number transmitted to the housing closest to the siren. The further the housing is away from the focus of the fire, the more the signal is modulated (insertion of silences, power reduction, or the like).

Each emitter of a housing is equipped with a siren whose signal can be modulated. In fact, only the sirens outside a building, for example, can howl at full power. The sirens inside the building are, on the other hand, modulated as a function of the location of the housing with respect to the start of the fire. Such an embodiment then improves the locating of the focus and reduces the sound nuisances to the occupants of the building without being detrimental to safety. The location remains accurate even in the case of reconfiguration of the premises.

In the second embodiment in which a central supervisory unit is used, the housings do not have a short-range radio link but the central supervisory unit stores the physical position of each housing and modulates the power of the sirens that the emitters of the closest housings emit as a function of their distance from the detector closest to the focus of the fire.

The memory of the UCS unit storing the location of the housings is updated on each reconfiguration of the premises.

Thus, in the first as in the second embodiment above, if the modulation introduced is an extension of the duration of silence between two tones, the fire fighters can register the sound in the smoke to go to the point where the sound is the closest possible to a continuous sound. Even in the absence of smoke, the intuitive location by noise allows for a reduction of the response times compared to familiarization with the premises on a plan. Likewise, the evacuated people can go to the emergency exit that is the least noisy out of those which are the closest, reducing the risks of asphyxia of people who chose the wrong direction (that which leads to the focus of the fire), in the presence of poisonous smoke.

It will be noted that the modulation can be represented by a number of successive sound beeps per unit of time, as illustrated in FIG. 4. However, as a variant, it can be a lower sound frequency (therefore still of lesser energy) for a housing situated further away from the start of the fire.

Figure 5:
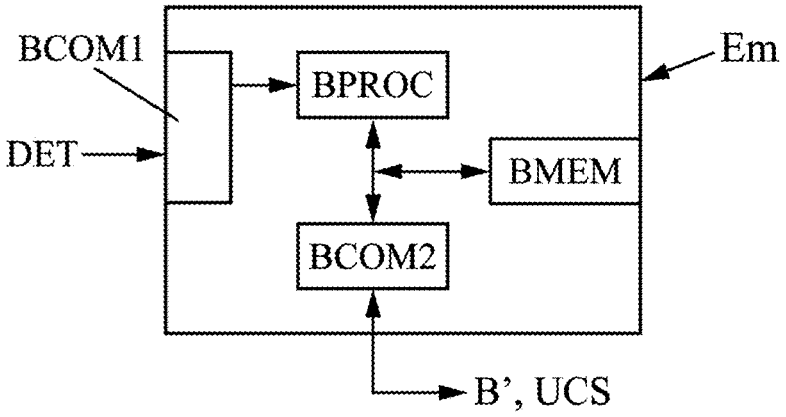
FIG. 5 schematically illustrates the processing circuit of an emitter according to the abovementioned first embodiment.
Figure 7:
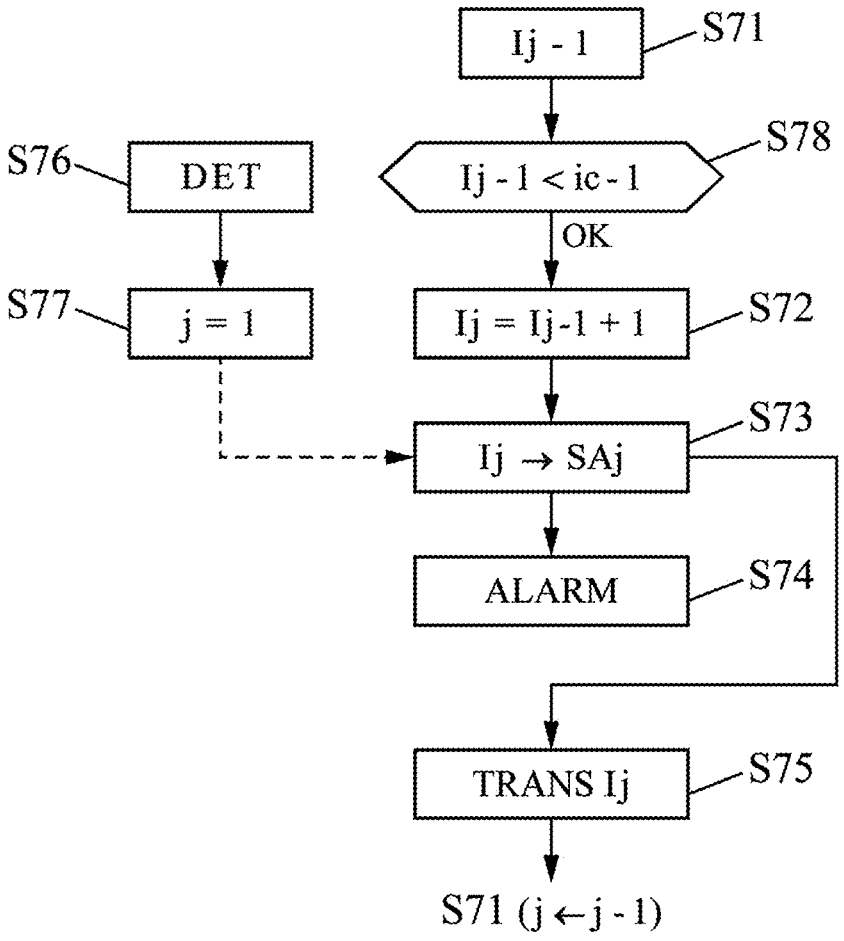
FIG. 7 shows, by way of example, the steps of a method implemented by an emitter according to the first embodiment.

With reference now to FIG. 5, a detector Em of a housing B comprises:

- a first interface BCOM1 for receiving, from a detector DET of the same housing B, a possible event detection signal,
- a second interface BCOM2, for communication with the emitters of neighboring housings B' by a short-range radio link in the first embodiment (or with the central supervisory unit UCS in the second embodiment), a memory BMEM storing at least the mapping table of FIG. 3, and instructions of a computer program, an algorithm of which is illustrated, by way of example, by the flow diagram of FIG. 7 discussed later, a processor BPROC cooperating with the memory BMEM and the interfaces BCOM1, BCOM2, for the implementation of a method within the meaning of the present disclosure, illustrated in FIG. 7 as the above-mentioned first embodiment.

Figure 6:
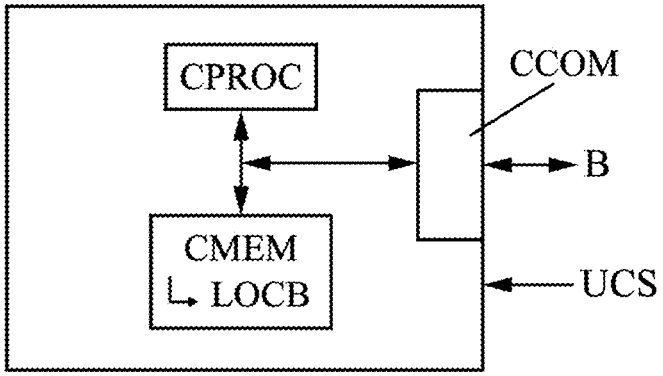
FIG. 6 schematically illustrates the processing circuit of a central supervisory unit according to the abovementioned second embodiment.
Figure 8:
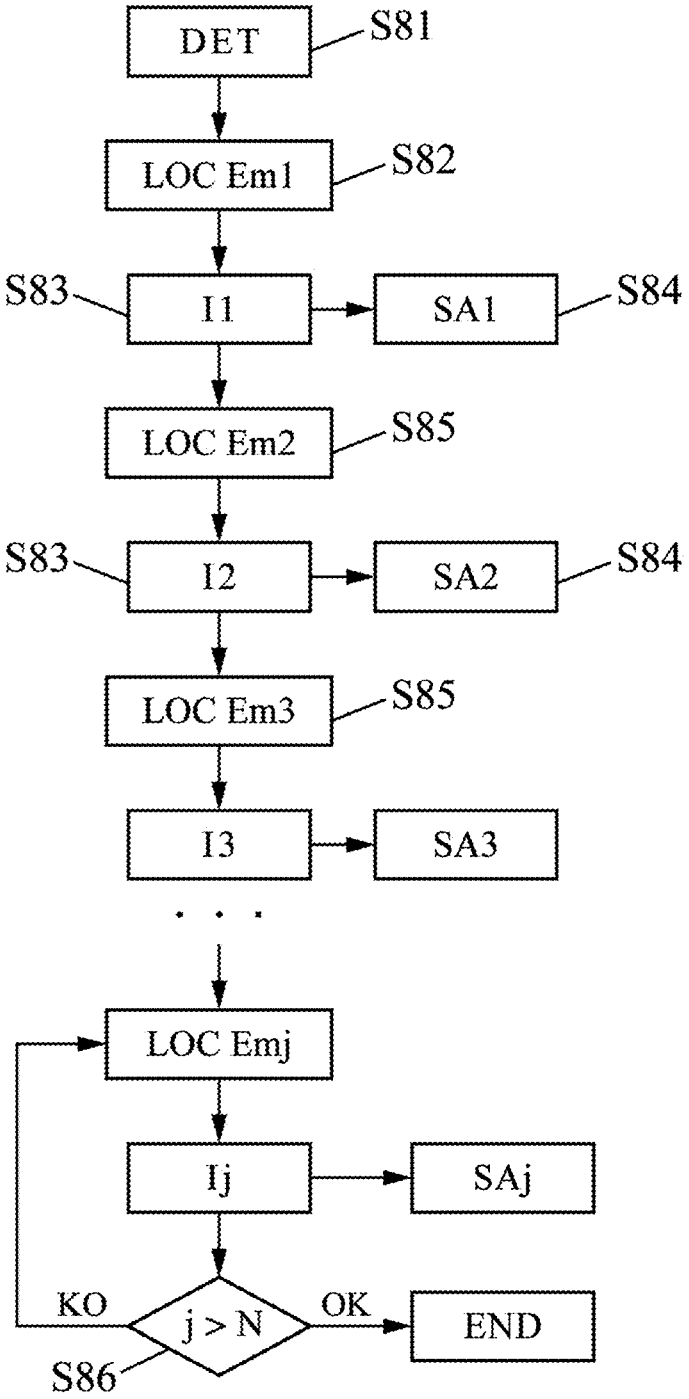
FIG. 8 shows, by way of example, the steps of a method implemented by a central supervisory unit according to the second embodiment.

With reference now to FIG. 6, a central supervisory unit UCS, according to the second embodiment, comprises:

an interface CCOM for receiving, from a detector DET of a housing B, a possible event detection signal, and for transmitting, to the emitters Em of the housings B, appropriate alarm signal emission instructions as a function of their location, a memory CMEM storing at least the location data of each detector and each emitter of the alarm system, and instructions of a computer program, an algorithm of which is illustrated, by way of example, by the flow diagram of FIG. 8 discussed later, a processor CPROC cooperating with the memory CMEM and the interface CCOM, for the implementation of a method within the meaning of the disclosure, illustrated in FIG. 8 as the abovementioned second embodiment.

With reference to FIG. 7, an emitter Em according to the first embodiment receives, in the step S71, an identifier Ij−1 of another emitter within its radio frequency range. In the step S72, the emitter Em modifies, by incrementation for example, this identifier Ij−1 to form a new identifier Ij specific to this emitter Em. In the step S73, the emitter Em retrieves from its memory BMEM the alarm signal SAj corresponding to this identifier Ij and to be emitted in the step S74. In parallel with the emission of the alarm S74, the emitter Em transmits, in the step S75, its identifier Ij to the other emitters within its radio frequency range. The steps S71 to S77 are then repeated by an emitter receiving this identifier Ij (the identifier Ij replacing the preceding identifier Ij−1). It should be noted that the emitter Em can at any time receive the event detection signal from the detector DET with which it is associated (in the same housing or within its detection environment). In this case (step S76), it is programmed to directly be assigned the index I1 in the step S77 and to implement the steps S73 to S75 by emitting the alarm signal SA1 with the highest energy (or power, if this energy is taken per unit of time).

Multiple starts of fires are possible, so it thus appears that several emitters Em can have the identifier I1 corresponding to the alarm signal SA1. In fact, these emitters can receive, directly from their detector DET, an event detection signal and then be assigned the first identifier I1.

In this case, the emitters Em situated between these two starts of fires can have an identifier Ij with j>1, but the proximity of a new start of a fire will lead to a reduction of the neighboring identifiers. Thus, an emitter Em receiving an identifier Ij−1 checks whether this identifier is lower than a current identifier ic specific to this emitter Em (more specifically, this current identifier ic minus 1), in the step S78 of FIG. 7. If such is the case (OK arrow at the output of the test S78), this emitter implements the steps S72 to S75. Otherwise, it simply disregards the reception of this identifier Ij−1 because, even after the incrementation of the identifier Ij−1, the resulting identifier Ij would still be greater than or equal to the current identifier ic of this emitter Em, which can continue to emit its alarm signal of stronger energy and corresponding to its current identifier ic.

With reference now to FIG. 8, a central supervisory unit UCS, on reception of an event detection signal from a detector DET in the step S81, consults the content of its memory CMEM to locate this detector DET and identify, in the step S82, the emitter Em1 that is located as being the closest to this detector DET. The UCS unit assigns and transmits to this emitter Em1 the first identifier I1 in the step S83. On reception of this identifier I1, the emitter Em1 is activated to emit the first alarm signal SA1 in the step S84.

Furthermore, the UCS unit consults its memory CMEM to identify, in the step S85, the second emitter Em2 located as being the closest to the first emitter Em1. The UCS unit can assign and transmit the identifier I2 to this second emitter Em2 to activate it with the alarm signal SA2, according to the same principle of the preceding steps S83 and S84. These steps S85, S83, S84 are repeated with the N emitters that the alarm system comprises (apart from one or more emitters at the periphery of the building) to activate, step-by-step, these emitters with successive alarm signals SAj, as long as the maximum number N of emitters has not been reached (KO arrow at the output of the test S86).

In the first embodiment as in the second embodiment, the emitters emit alarm signals comprising fewer pulses per unit of time as they become more distant from the detector that detected the event. Such an embodiment makes it possible to effectively guide the responders to the place of the event.

The invention claimed is:

1. A method for managing an alai in system, the alarm system comprising:

a plurality of detectors, each configured to detect an event in an environment defined by a range of detection of the detector, and to emit, in case of the detection of an event, an event detection signal; and a plurality of alarm signal emitters, each configured to emit at least one alarm signal in case of the detection of an event, the detectors and the emitters being linked to one another, wherein each of the emitters is configured to emit a plurality of distinct alarm signals, and wherein the method comprises at least:

a) in case of the detection of an event by a first detector, assigning a first identifier to at least one first emitter, the closest to the first detector out of the plurality of emitters, and transmitting an alarm generation instruction to the first emitter with the first identifier, to activate the first emitter with a first alarm signal which is a function of the first identifier, b) modifying the first identifier to produce a second identifier from the first identifier and assigning the second identifier to at least one second emitter, the closest neighbor of the first emitter, and c) transmitting an alarm generation instruction to the second emitter, to activate the second emitter with a second alai in signal which is a function of the second identifier.

2. The method as claimed in claim 1, further comprising:

d) repeating b) and c) N times by transmitting an alarm generation instruction to at least one $N^{th}$ next emitter, the closest neighbor of an $N-1^{th}$ preceding emitter, to activate the $N^{th}$ next emitter with an alarm signal which is a function of an $N^{th}$ identifier assigned to the $N^{th}$ emitter, the $N^{th}$ identifier having been produced from an $N-1^{th}$ identifier assigned to the $N-1^{th}$ emitter.

3. The method as claimed in claim 1, wherein the first emitter is located in the environment of the first detector.

4. The method as claimed in claim 1, wherein each of the emitters is configured to emit a plurality of alarm signals that are distinguished by respective modulations chosen to confer on each alarm signal a decreasing energy as a function of a number of successive modifications applied to the first identifier.

5. The method as claimed in claim 4, wherein each alarm signal comprises a succession of pulses with a chosen number of pulses per unit of time, and wherein the number of pulses per unit of time in an alarm signal decreases as a function of the number of successive modifications applied to the first identifier.

6. The method as claimed in claim 4, wherein, the alarm system being installed in a building and comprising at least one secondary emitter at the periphery of the building, the secondary emitter is activated at least in c) to emit an alarm signal of maximum energy out of the alarm signals.

7. The method as claimed in claim 1, wherein the emitters can communicate with one another via a short-range radio frequency link and wherein c) precedes b), and, in c), the first emitter emits the first identifier with an alarm generation instruction to at least one emitter within its range, and at least the second emitter, within the radio frequency range of the first emitter, on reception of the alarm generation instruction with the first identifier, modifies the first identifier to produce the second identifier according to b), the method continuing with an emission, by the second emitter, of an alarm generation instruction with the second identifier, to at least one emitter within the range of the second emitter.

8. The method as claimed in claim 1, wherein the emitters can communicate with one another via a short-range radio frequency link and wherein c) follows b), and, in b), the first emitter modifies the first identifier to produce the second identifier, and, in c), the first emitter emits the second identifier with an alarm generation instruction to at least one emitter within its range, and at least the second emitter, within the radio frequency range of the first emitter, on reception of the alarm generation instruction with the second identifier, emits the second alarm signal which is a function of the second identifier and modifies the second identifier to produce a third identifier, the method continuing with an emission, by the second emitter, of an alarm generation instruction with the third identifier, to at least one emitter within the range of the second emitter.

9. The method as claimed in claim 7, wherein the radio frequency link is of Bluetooth type.

10. The method as claimed in claim 1, wherein the detectors and the emitters are linked to one another via a central unit, storing location data of the detectors and of the emitters in memory, and wherein the central unit:

on reception of an event detection signal from the first detector, locates the first emitter as emitter closest to the first detector as a function of the data stored in memory, assigns the first identifier to the first emitter, and emits an alarm generation instruction with the first identifier to the first emitter for the implementation of a), and locates the second emitter as emitter closest to the first emitter as a function of the data stored in memory, modifies the first identifier to produce the second identifier according to b), assigns the second identifier to the second emitter, and emits an alarm generation instruction with the second identifier to the second emitter for the implementation of c).

11. A non-transitory computer storage medium comprising instructions of a computer program for the implementation of the method as claimed in claim 1, when the instructions are executed by a processor of a processing circuit.

12. An alarm system comprising:

a plurality of detectors, each configured to detect an event in an environment defined by a range of detection of the detector, and to emit, in case of the detection of an event, an event detection signal; and a plurality of alarm signal emitters, each configured to emit at least one alarm signal in case of the detection of an event, the detectors and the emitters being linked to one another, wherein each of the emitters is configured to emit a plurality of distinct alarm signals, and wherein:

a) in case of the detection of an event by a first detector, a first identifier is assigned to at least one first emitter, the closest to the first detector out of the plurality of emitters, and an alarm generation instruction is transmitted to the first emitter with the first identifier, to activate the first emitter with a first alarm signal which is a function of the first identifier, b) the first identifier is modified to produce a second identifier, and c) an alarm generation instruction is transmitted to at least one second emitter, the closest neighbor of the first emitter, to activate the second emitter with a second alarm signal which is a function of the second identifier.

13. An emitter of an alarm system as claimed in claim 12, wherein the emitter is configured to emit a plurality of distinct alai in signals, and stores data of the alarm signals in memory matched with respective identifiers, to emit a specific alarm signal as a function of a given identifier.

14. The emitter as claimed in claim 13, wherein the emitter communicates with the emitters of the system via a short-range radio frequency link, and wherein the emitter is configured to:

receive an alarm generation instruction with a current identifier, modify the current identifier to produce a modified identifier, emit an alarm signal which is a function of the modified identifier, and emit, via the radio frequency link, an alarm generation instruction with the modified identifier.

15. A central unit of an alarm system as claimed in claim 12, configured to be linked to the detectors and to the emitters of the system and wherein it is further configured to store location data of the detectors and of the emitters in memory, and wherein the central unit is further configured to:

on reception of an event detection signal from the first detector, locate the first emitter as emitter closest to the first detector as a function of the data stored in memory, assign the first identifier to the first emitter, and emit an alarm generation instruction with the first identifier to the first emitter, locate the second emitter, as emitter closest to the first emitter as a function of the data stored in memory, modify the first identifier to produce the second identifier, assign the second identifier to the second emitter, and emit an alarm generation instruction with the second identifier to the second emitter.

* * * * *